United States Patent [19]

Lakhani

[11] 3,934,112

[45] Jan. 20, 1976

[54] DRYING AND FIXING TECHNIQUES FOR ELECTROGRAPHIC PRINTING SYSTEM

[75] Inventor: Kishor M. Lakhani, Oklahoma City, Okla.

[73] Assignee: Honeywell Information Systems, Inc., Waltham, Mass.

[22] Filed: Mar. 4, 1974

[21] Appl. No.: 447,700

[52] U.S. Cl. ..... 219/216; 101/426; 219/388

[51] Int. Cl.[2] ..... H05B 1/00; G03G 15/00

[58] Field of Search ..... 219/216, 388; 355/3; 432/59, 227

[56] References Cited

UNITED STATES PATENTS

| | | | |
|---|---|---|---|
| 3,123,700 | 3/1964 | Snyder et al. | 219/388 |
| 3,448,970 | 6/1969 | Kolibas | 219/216 |
| 3,649,808 | 3/1972 | Garbe | 219/388 X |

*Primary Examiner*—C. L. Albritton
*Attorney, Agent, or Firm*—Ronald T. Reiling

[57] ABSTRACT

An electrographic printing system in which an improved apparatus and method are used to evaporate a volatile carrier used to deposit toner particles on a printing medium from the medium, and to fix the deposited colored toner particles permanently to the medium. The apparatus includes a unique platen and electrical heaters for dissipating different amounts of electrical power in different areas of the platen. The circulation system circulates air over the platen in order to maintain the concentration of carrier vapor below a maximum safe level.

21 Claims, 6 Drawing Figures

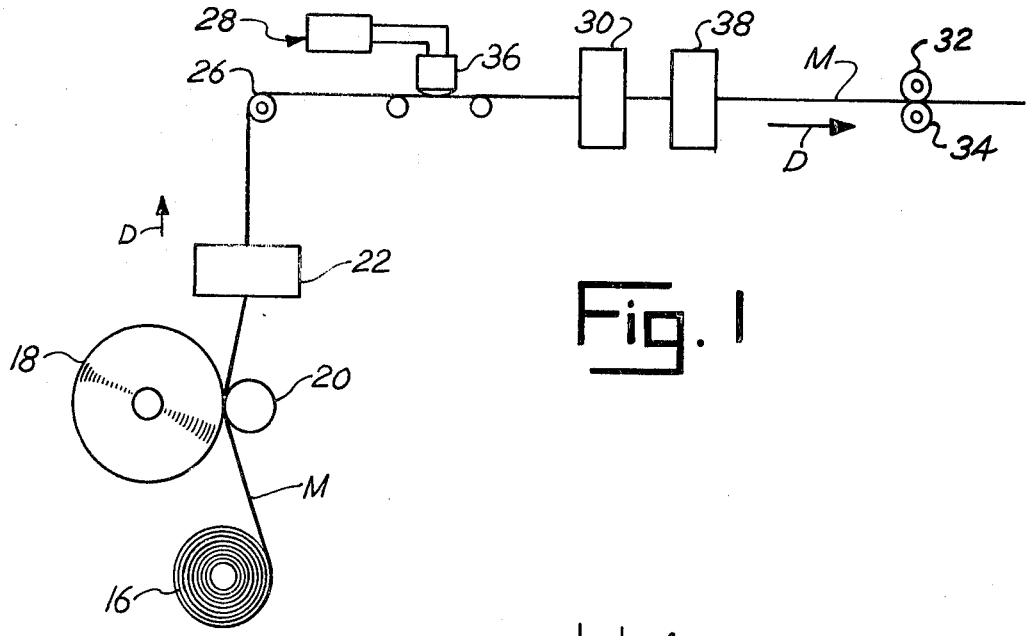
Fig. 1
Fig. 2
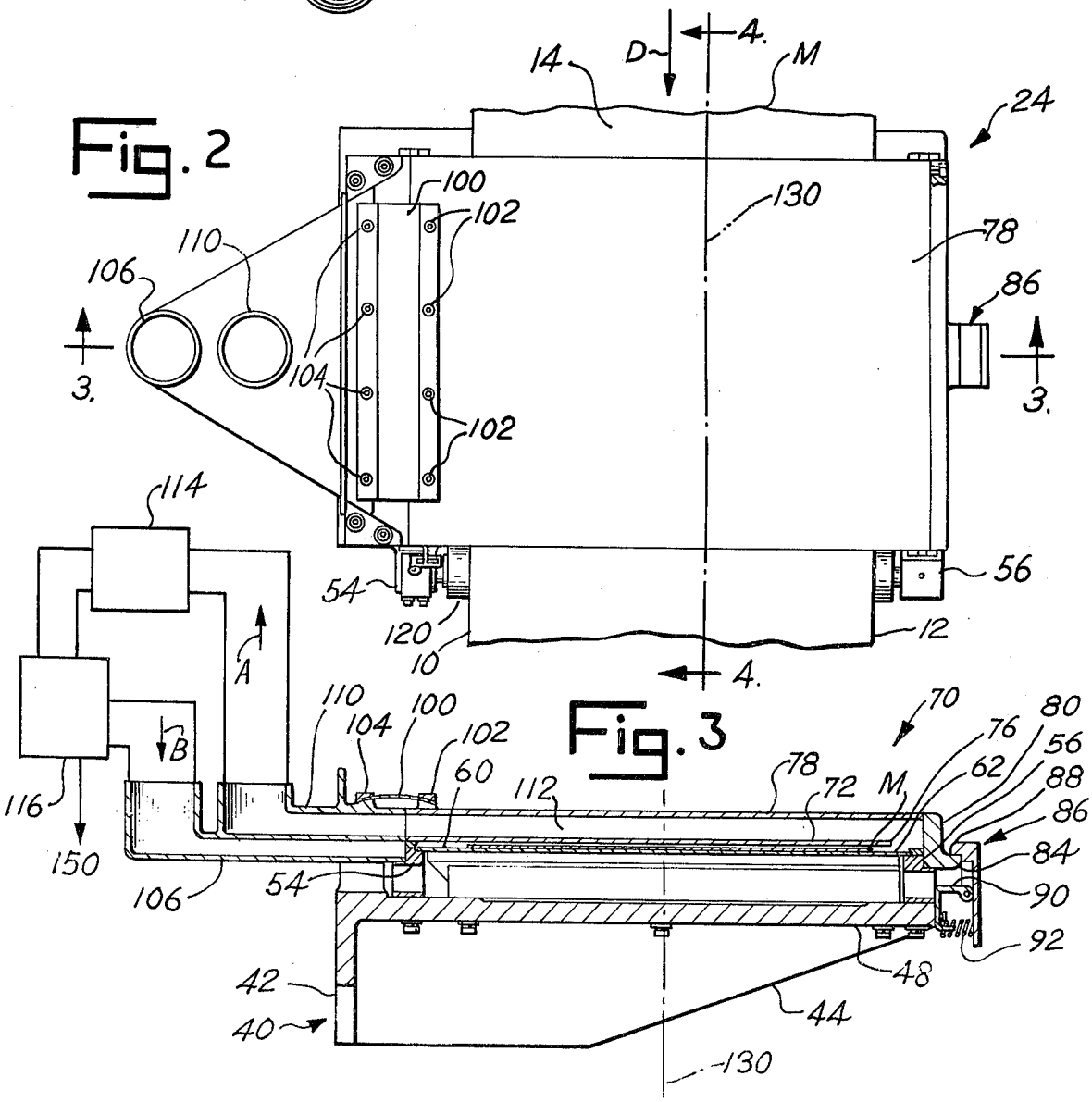
Fig. 3

DRYING AND FIXING TECHNIQUES FOR ELECTROGRAPHIC PRINTING SYSTEM

BACKGROUND AND SUMMARY OF THE INVENTION

The present invention relates to non-impact printing and more particularly relates to an electrographic printing system in which a liquid carrier is removed from the printing medium in order to fix colored toner particles on the medium.

In the past, non-impact, electrographic printing systems have been proposed for use in connection with data processing systems in order to increase the speed on which data can be permanently recorded on a printing medium. Two prior art electrographic printing systems are described in U.S. Pat. No. 3,687,107 (Borelli et al — Aug. 29, 1972) and U.S. Pat. No. 3,701,337 (Borelli et al — Oct. 31, 1972).

According to these proposals, printing is done on a printing medium composed of a conductively treated paper base that supports a plastic dielectric coating. The medium is positioned between an electrode that contacts the conductive base and a second electrode whose surface is shaped or selectively changed to conform to the image to be printed. A high voltage applied between the two electrodes excites the paper medium and establishes an electrostatic field across the dielectric coating. The coating retains a residual electrostatic field that constitutes a charged latent image of the shape to be printed.

The latent image is developed, that is, made visible by contacting the paper medium with charged toner particles. These particles are applied from a suspension of liquid toning carrier and toner particles. The carrier also softens the particles. The residual electrostatic field of the dielectric surface attracts these particles and holds them, thus making the image visible.

The image is then fixed or made permanent by vaporizing the liquid carrier with heat. When the liquid carrier is removed, the particles remain, and through application of heat are hardened and bond themselves to the coating.

Vaporizing the liquid carrier creates problems. It produces vapors which, if generated at rapid rates and accumulated in large quantities, may be irritating or harmful. The rate of evaporation with the environment can tolerate limits the speed of printing. On the other hand, if the carrier is not rapidly evaporated, the medium is too wet and it cannot be processed without reducing its speed of travel through the take up rolls to unacceptably low levels. Attempts to cope with these conflicting design requirements in the past have been unsuccessful.

The foregoing problems have been solved by providing a heater platen having an inlet edge over which the printing medium is first passed and an exit edge over which the printing medium leaves the platen. The platen is provided with separate electrical heater elements which dissipate controlled quantities of electrical power in separate defined areas of the platen.

It has been discovered that the quantity of power dissipated adjacent the inlet edge must be greater than the quantity of power dissipated adjacent the exit edge.

According to another feature of the invention, the quantity of electrical power dissipated adjacent the edges of the printing medium exceeds the quantity of power dissipated in the central portion of the printing medium between the edges.

According to yet another feature of the invention, the heater elements are connected together to form separate electrical circuits controlled by independent switches in order to accommodate printing media having different widths.

According to still another feature of the invention, the heater platen is supported by a cantilever and the heater elements adjacent the unsupported or cantilevered side of the platen are maintained at higher temperatures than the heater elements adjacent the side of the platen supported by a frame.

According to another feature of the invention, the gas is cooled before it is circulated over the platen in order to reduce the concentration of carrier vapor.

According to still another feature of the invention, the carrier is evaporated by a unique method in which the printing medium is passed through defined spaces in which heat is generated at different rates.

By using the foregoing features and others described in the following detailed description of a preferred embodiment, it has been possible to safely evaporate carrier liquid from a printing medium moving at 30 inches per second, thereby drastically increasing the speed with which information can be printed and fixed on the medium

DESCRIPTION OF THE DRAWINGS

These and other objects, advantages and features of the present invention will be described in connection with the accompanying drawings in which:

FIG. 1 is a schematic diagram of an electrographic printing system employing a preferred form of the present invention;

FIG. 2 is a plan view of a preferred form of drying station made in accordance with the present invention;

FIG. 3 is a cross sectional view taken along line 3—3 in FIG. 2;

FIG. 7 is a cross sectional view of the heater platen and electrical elements taken along line 7—7 in FIG. 5.

DESCRIPTION OF THE PREFERRED EMBODIMENT

Figure 4:
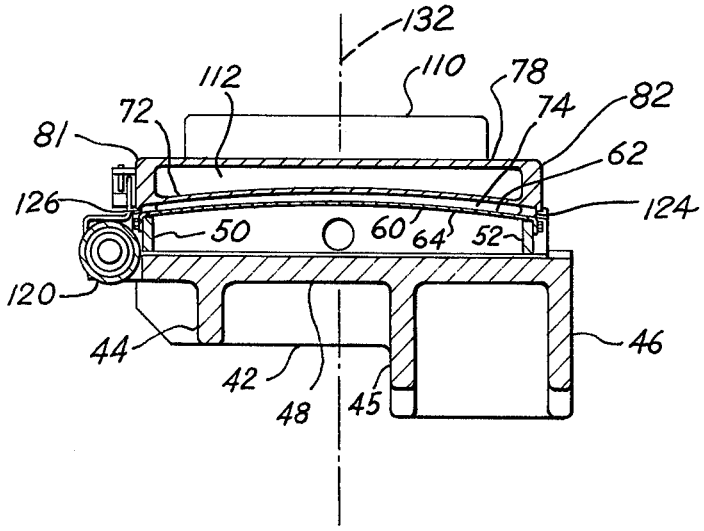
FIG. 4 is a cross sectional view taken along line 4—4 in FIG. 2.

Referring to FIGS. 1 and 2, the present invention is adapted for use in connection with a sheet printing medium M having opposed, parallel edges 10 and 12 and a central area 14 located between the edges. Medium M is a plane surface electrographic medium of the type known in the art having a dielectric side and an opposite conductive side for receiving and retaining an electrostatic charge which is later developed into electrographic printing.

Referring to FIG. 1, printing medium M is stored on a roll 16 which is provided for continuous operation of the electrographic printing process. A forms station, which is here depicted as a forms drum 18 and a backup roller 20, is located down stream of the electrographic paper supply roll 16 but prior to any other device for operating on medium M.

Immediately after the forms station, a toner station 22 is located, such that the forms information is developed on the electrostatic medium prior to receiving any variable information. Toner station 22 may include any type of such device well known in the art, or preferably of the type shown in U.S. Pat. No. 3,687,107 and U.S. Pat. No. 3,701,337 issued in the name of Borelli et al, which are assigned to the assignee of the present invention. As a complete discussion of the elements and operation of such devices as found in these references, no further discussion is deemed necessary for an understanding of the present preferred embodiment.

From toner station 22, electrographic medium M passes through a drying station 24, over a roller 26 and to a print station 28 at which variable information is placed on the medium in the form of an electrostatic charge. Medium M then passes through a second toner station 30 and another drawing station 38 to a pair of dry rollers 32 and 34 which serve to move the medium through the apparatus. Toner stations 22 and 30 and drying stations 24 and 38 may be identical. Although two drying stations are illustrated, preferably a single drying station is employed and it is positioned downstream of second toner station 30.

Print station 28 is of the type which receives variable information from a data processor or other equipment, and through selective charging of a plurality of electrodes or excitation means, disposed in a print head 36, generates alphanumeric characters or other variable printing by electrostatic discharge onto medium M. The details of print station 28 have not been illustrated. However, the specific elements of such a station, together with an explanation of its operation, are shown and described in U.S. Pat. No. 3,624,661 issued to Shebanow et al. As a result, no further discussion of the station is required.

In operation, medium M is fed from supply roller 16 through the various stations described and shown in FIG. 1. Forms drum 18 is biased against a backup roller 20 and the conductive side of printing medium M is arranged to contact with backup roller 20. A relatively high potential of about +700 volts is applied to roller 20. An electrostatic image is generated by switching conductive drum 18 to ground potential, thereby causing ionization to occur between raised characters located on drum 18 and the conductive side of medium M.

In the arrangement illustrated, printing medium M is held taut around a section of backup roller 20 and is pulled by a drive mechanism attached to rollers 32 and 34 which form a driving means capable of driving the medium at 30 inches per second or more. Medium M, in turn, drives roller 20 which drives drum 18. After passing between rollers 18 and 20, medium M passes through forms station 22 which contains a toning liquid comprising a suspension of colored particles in a volatile carrier, such as kerosene. A preferred carrier is a highly paraffinic liquid such as Isopar G. Printing medium M then travels through drying station 24 shown in FIGS. 2–7. From drying station 24, printing medium M travels through electrographic printing apparatus to print station 28 where variable information is printed on the medium. The printing medium is subsequently developed at toner station 30 and drying station 38 to complete the printing process.

Referring to FIGS. 2–4, a preferred form of drying station 24 or 38 comprises a frame 40 having a vertical member 42 which supports cantilevers 44, 46. The frame supports a horizontal table 48 which carries end struts 50, 52 and side struts 54, 56. The struts, in turn, support an aluminum sheet heater platen 60 which forms a portion of the perimeter of a cylinder having a 20 inch radius. The platen has an upper surface 62 and a lower surface 64. Platen 60 forms a portion of the lower side of a chamber assembly 70. Assembly 70 includes a cover plate 72 which is located parallel to platen 60. The space between cover plate 72 and platen 60 forms a slot-shaped chamber 74 about 1/8 inch in height. As best shown in FIG. 3, cover plate 72 terminates in an edge 76 around which gas, i.e., air, may escape from chamber 74.

Assembly 70 also includes a top plate 78 having depending side walls 80, 82 which mate with cover plate 72. Side wall 80 comprises a lip 84 which mates with a lip 88 of a releasable lock assembly 86 comprising a lever 90 and a spring 92.

Top plate 78 is hinged to the frame via a flexible sheet 100 which is attached to top plate 78 by rivets 102 and to an outlet duct 110 by rivets 104.

Outlet duct 110 receives air flowing through a space 112 formed between top plate 78 and cover plate 72. Space 112, in turn, receives gas, i.e., air, flowing around edge 76 and through chamber 74 from an inlet duct 106. Air flowing out through outlet duct 110 communicates with a blower 114 which circulates air in a direction shown by arrows A and B at the rate of 45 cubic feet per minute. Before passing through inlet duct 106, the air is cooled by conventional condensor coils 116. The air in the inlet duct and outlet duct comprises a mixture of air and vaporized carrier fluid. A portion of the carrier fluid is condensed from the air by coils 116 and is removed via line 150. The air is cooled to about 56°F before being transmitted to chamber 74. This is an important feature which helps to increase the evaporation rate of the carrier fluid on medium M due to the low amount of carrier in the air.

As best shown in FIGS. 2 and 4, an inlet roller 120 is rotatably journaled on struts 54 and 56. The inlet roller is located adjacent an inlet port 124 through which medium M is pulled in the direction of arrow D. An exit port 126 is located opposite inlet port 124 and provides a slot through which paper printing medium M is withdrawn from chamber 74. The relative positions of inlet port 124, exit port 126 and the cylindrical, curved shape of platen 60 are important features which help to hold the printing medium firmly in contact with upper surface 62 of the platen as the paper travels through chamber 74.

Figure 5:
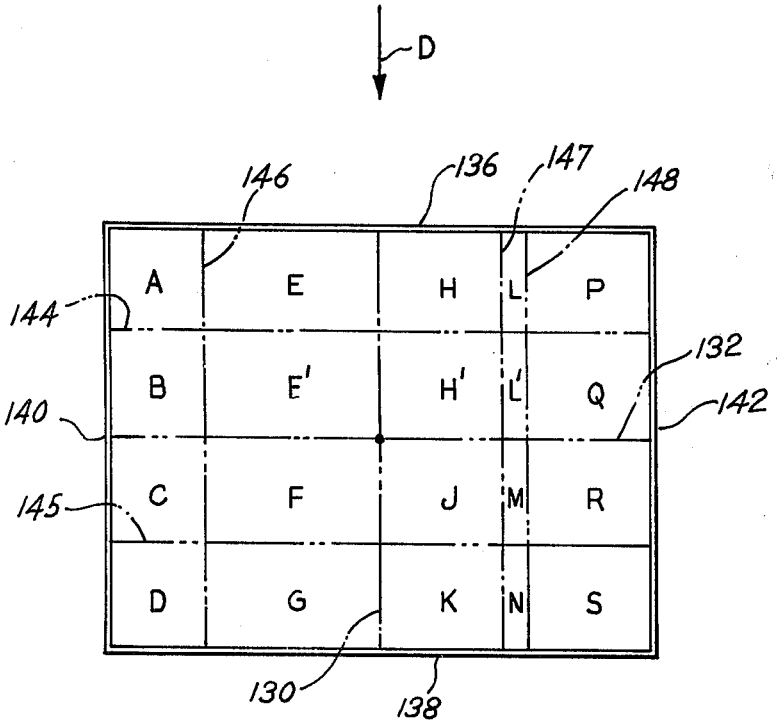
FIG. 5 is a plan view of the heater platen shown in FIGS. 3 and 4.
Figure 6:
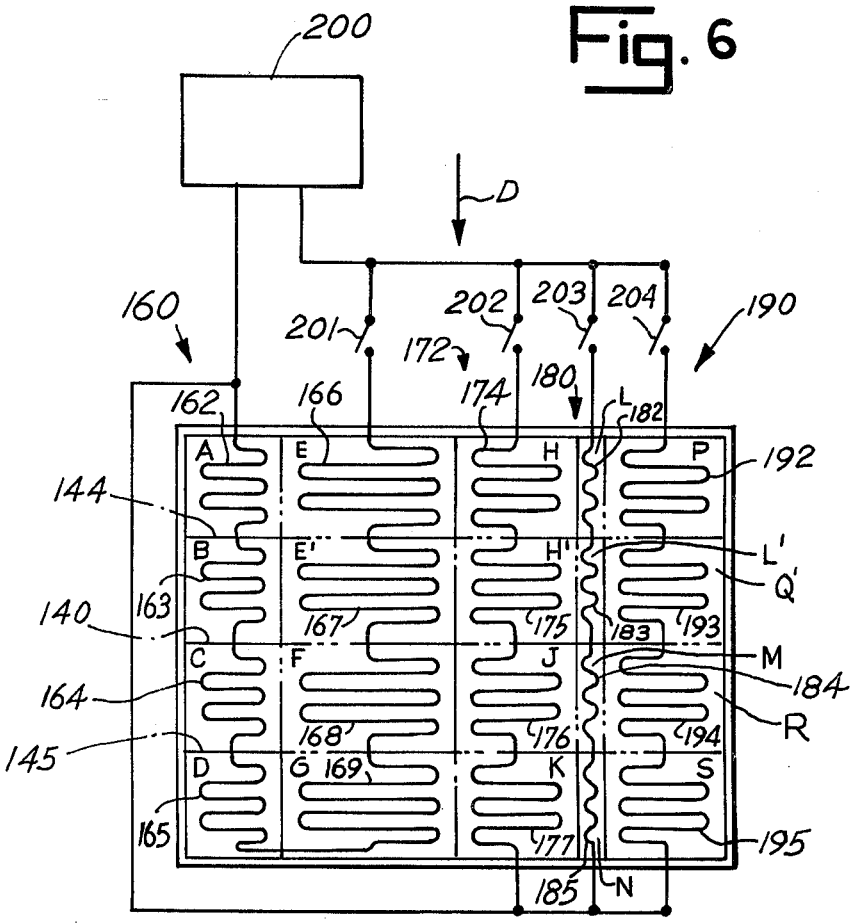
FIG. 6 is a plan schematic diagram of the heating elements located below the heater platen shown in FIG. 5.

Referring to FIG. 5, platen 60 defines a plane 130 which is parallel to direction D of travel of medium M and which bisects platen 60 from left to right. Platen also defines another plane 132 perpendicular to platen 130 which bisects platen 60 from inlet to exit. Platen 60 has an inlet edge 136 adjacent inlet port 124 and an opposed exit edge 138 adjacent exit port 126. Side edges 140 and 142 extend between inlet edge 136 and exit edge 138. The platen is divided by imaginary lines 144–148 into 20 distinct areas, A-S. Each area has a separate heater element as shown in FIG. 6, which dissipates the quantity of electrical power per unit of the area shown in the following Table A.

TABLE A

| AREA | AVERAGE POWER DISSIPATED BY HEATER ELEMENT AREA IN WATTS PER SQUARE INCH |
|---|---|
| A | 39.1 |
| B | 36.8 |
| C | 31.1 |
| D | 20.7 |
| E | 34.5 |
| E' | 34.5 |
| F | 28.2 |
| G | 18.4 |
| H | 34.5 |
| H' | 34.5 |
| J | 28.2 |
| K | 18.4 |
| L | 34.5 |
| L' | 34.5 |
| M | 28.2 |
| N | 18.4 |
| P | 39.1 |
| Q | 36.8 |
| R | 31.1 |
| S | 20.7 |

The temperature of the heater elements for areas A-S are maintained at the values shown in the following Table B.

TABLE B

| AREA | AVERAGE TEMPERATURE IN DEGREES CENTIGRADE OF HEATER ELEMENT IN AREA |
|---|---|
| A | 220 |
| B | 230 |
| C | 290 |
| D | 260 |
| E | 200 |
| E' | 290 |
| F | 320 |
| G | 290 |
| H | 200 |
| H' | 280 |
| J | 330 |
| K | 320 |
| L | 200 |
| L' | 280 |
| M | 330 |
| N | 320 |
| P | 230 |
| Q | 280 |
| R | 335 |
| S | 320 |

It should be noted that the electrical power dissipated in the areas A, E, H, L and P is maximum adjacent inlet port 124. It is possible to increase the power dissipated in these areas because the evaporation of carrier liquid from the printing medium tends to cool the paper, platen and heater element. As a result, the temperature of the heater elements, as shown in Table B, remains lower than the temperature of the heater elements in area D, G, K, N and S. It should also be noted that the power dissipated in side areas A, B, C, D, P, Q, R and S is greater than the amount of power dissipated in the central area E, E', F, G, H, H', J, K, L, L', M and N. This is an important feature which maintains a uniform drying capability across the entire width of the printing medium. In addition, the temperature of the element in areas P, Q, R and S is maintained higher than the temperature of the heater elements in the other areas. This is an important feature which maintains uniform driving capability in zones P-S even though the paper is held less tightly to the platen due to the cantilever suspension of table 48. By maintaining the temperature of the elements in areas P-S somewhat higher than the other areas, uniform drying and curing properties can be maintained across the entire width of the medium M in spite of the non-uniform pressure between medium M and various areas of platen 60.

The heater elements A-S are joined together to form individually operable electrical circuits. A first circuit is formed by connecting the heater elements in areas A, B, C, D, E, E', F and G. The second electrical circuit is formed by connecting the heater elements in the areas H, H', J and K. The third electrical circuit is formed by connecting the heater elements in areas L, L', M and N, and a fourth electrical circuit is formed by connecting the heater elements in areas P, Q, R and S. By switching the circuits independently in operation, by means of the switches shown in FIG. 6, printing media with diverse widths can be accommodated. For example, in order to dry a printing medium 5 to 5½ inches wide, the first electrical circuit alone is energized. In order to accommodate printing media 7½ to 8 inches wide, the first and second electrical circuits alone are energized. In order to accommodate a printing medium 8½ inches wide, the first, second and third electrical circuits alone are energized. In order to accommodate an 11 inch wide printing medium, all of the electrical circuits (first through fourth) are simultaneously energized. This is an important feature which enables a uniform drying and carrying capability to be maintained across the entire width of a printing medium having diverse dimensions.

According to the method aspect of the preferred embodiment, the projection of the boundary lines of areas A-S define spaces between upper platen surface 62 and cover plate 72. The heater elements below the platen vary the rate at which heat is generated in each of the defined spaces in proportion to the average power dissipated in the corresponding areas listed in Table A. As the printing medium passes through each defined space in chamber 74, carrier fluid is rapidly evaporated over areas A, E, H, L and P and the colored particles are fixed to the printing medium and remaining areas. As the printing medium is passing through chamber 74, blower 114 moves air in the direction of arrow B (FIG. 3) through inlet duct 106, chamber 74, around the right hand end of edge 76, and from right to left through space 112, through outlet duct 110. As previously described, the air entering inlet duct 106 is precooled to about 56°F by condensor coils 116. To remove carrier and moisture which may be present in the air, the condensed carrier and/or moisture is removed by line 150 for further processing and recovery. The temperature of the inlet gas should be maintained above 32°F to maximize the rate of evaporation of the carrier fluid from medium M. The proximity of cover plate 72 to platen 60 reduces the size of the chamber 74 and offers the following advantages.

1 The volume of air in chamber 74 is minimized to reduce the capacity required for condensor coils 116; and 2 The velocity of the gas passing through chamber 74 is maximized to increase the rate of evaporation of the carrier fluid.

Those skilled in the art will recognize that the specific embodiment as described herein may be altered and modified without departing from the true spirit and scope of the invention as defined in the appended claims.

What is claimed is:

1. In an electrographic printing system including a print station for applying an electrostatic charge to a printing medium and a toner station for coating the printing medium with a toning liquid comprising a suspension of colored particles in a volatile carrier, the improved apparatus for evaporating the carrier from the medium and for fixing the colored particles permanently to the medium comprising in combination:

chamber means for defining a chamber having an inlet port and an opposed exit port;

means for moving the printing medium into the inlet port and out of the exit port in a predetermined direction at a predetermined speed;

platen means for supporting the printing medium in the chamber between the inlet port and the exit port, said platen means being substantially bisected by a first plane parallel to the predetermined direction and by a second plane perpendicular to the first plane, an inlet edge on the inlet side of the second plane adjacent the inlet port, an exit edge on the exit side of the second plane adjacent the exit port, a first side edge extended between the inlet edge and the exit edge on a first side of the first plane and a second side edge extending between the inlet edge and the exit edge on a second side of the first plane opposite the first side;

first electrical heater means for dissipating a first predetermined average quantity of electrical power per unit of area in a first side inlet area of the platen means located adjacent the first side edge between the inlet edge and the second plane;

second electrical heater means for dissipating a second predetermined average quantity of electrical power per unit of area in a first side exit area of the platen means located adjacent the first side edge between the exit edge and the second platen;

third electrical heater means for dissipating a third predetermined average quantity of electrical power per unit of area in a second side inlet area of the platen means located adjacent the second side edge between the inlet edge and the second plane;

fourth electrical heater means for dissipating a fourth predetermined average quantity of electrical power per unit of area in a second side exit area of the platen means located adjacent the second side edge between the exit edge and the second plane;

fifth electrical heater means for dissipating a fifth predetermined average quantity of electrical power per unit of area in a central inlet area of the platen means located between the first side inlet area and the second side inlet area on the inlet side of the second plane;

sixth electrical heater means for dissipating a sixth predetermined average quantity of electrical power per unit of area in a central exit area of the platen means located between the first side exit area and the second side exit area on the exit side of the second plane; and circulation means for circulating a gas through the chamber at a predetermined rate, so that the vaporization rate of the carrier from the printing medium is maximized by the heater means and the concentration of carrier vapor in the chamber is maintained below a predetermined value by the circulation means.

2. Apparatus, as claimed in claim 1, wherein the predetermined speed is greater than 1 foot per second.

3. Apparatus, as claimed in claim 1, wherein the surface of the platen means in contact with the printing medium defines a portion of a cylindrical surface.

4. Apparatus, as claimed in claim 1, wherein the first predetermined average quantity of electrical power per unit of area is greater than the second predetermined average quantity of electrical power per unit of area, and wherein the third predetermined average quantity of electrical power per unit of area is greater than the fourth average quantity of electrical power per unit of area.

5. Apparatus, as claimed in claim 4, wherein the fifth predetermined average quantity of electrical power per unit of area is greater than the sixth predetermined average quantity of electrical power per unit of area.

6. Apparatus, as claimed in claim 5, wherein the fifth predetermined average quantity of electrical power per unit of area is less than the first predetermined average quantity of electrical power per unit of area and is less than the third predetermined average quantity of electrical power per unit of area.

7. Apparatus, as claimed in claim 6, wherein the first predetermined average of quantity of electrical power per unit of area and the third average predetermined quantity of electrical power per unit of area are substantially equal.

8. Apparatus, as claimed in claim 7, wherein the second predetermined average quantity of electrical power per unit of area and the fourth predetermined average quantity of electrical power per unit of area are substantially equal.

9. Apparatus, as claimed in claim 1, wherein the fifth electrical heater means comprises:

seventh electrical heater means for dissipating a seventh predetermined average quantity of electrical power per unit of area in a first side central inlet area of the platen means located between the first side inlet area and the first plane on the inlet side of the second plane; and eighth electrical heater means for dissipating an eighth predetermined average quantity of electrical power per unit of area in a second side central inlet area of the platen means located between the second side inlet area and the first plane on the inlet area side of the second plane.

10. Apparatus, as claimed in claim 9, wherein the sixth electrical heater means comprises:

ninth electrical heater means for dissipating a ninth predetermined average quantity of electrical power per unit of area in a first side central exit area of the platen means located between the first side exit area and the first plane on the exit side of the second plane; and tenth electrical heater means for dissipating a tenth predetermined average quantity of electrical power per unit of area in a second side central exit area of the platen means located between the second side exit area and the first plane on the exit side of the second plane.

11. Apparatus, as claimed in claim 10, and further comprising:

first connector means for interconnecting the first electrical heater means, second electrical heater means, seventh electrical heater means and ninth electrical heater means into a first electrical circuit;

second connector means for interconnecting the eighth electrical heater means, and the tenth electrical heater means into a second electrical circuit;

third connector means for interconnecting the third electrical heater means and the fourth electrical heater means into a third electrical circuit;

first switch means for operating the first electrical circuit independently of the second and third electrical circuits;

second switch means for operating the second electrical circuit independently of the first and third electrical circuit; and third switch means for operating the third electrical circuit independently of the first and second electrical circuit, whereby the first, second and third electrical circuits can be independently energized to provide heat for printing media having different widths.

12. Apparatus, as claimed in claim 1, wherein the platen means is supported by a cantilever attached to a frame located adjacent the first side edge and displaced from the second side edge.

13. Apparatus, as claimed in claim 12, wherein the first electrical heater means is maintained at a first predetermined average temperature, the second electrical heater means is maintained at a second predetermined average temperature, the third electrical heater means is maintained at a third predetermined average temperature, the fourth electrical heater means is maintained at a fourth predetermined average temperature, the fifth electrical heater means is maintained at a fifth predetermined average temperature and the sixth electrical heater means is maintained at a sixth predetermined average temperature.

14. Apparatus, as claimed in claim 13, wherein the first predetermined average temperature is less than the second predetermined average temperature.

15. Apparatus, as claimed in claim 14, wherein the third predetermined average temperature is less than the fourth predetermined average temperature.

16. Apparatus, as claimed in claim 15, wherein the fifth predetermined average temperature is less than the sixth predetermined average temperature.

17. Apparatus, as claimed in claim 16, wherein the first predetermined average temperature is less than the third predetermined average temperature and the second predetermined average temperature is less than the fourth predetermined average temperature.

18. Apparatus, as claimed in claim 17, wherein the fifth predetermined average temperature is less than the first predetermined average temperature.

19. Apparatus, as claimed in claim 1, wherein the circulation means comprises:

a cover located over the platen so that the printing medium is between the cover and the platen, said cover being displaced from the platen by a predetermined distance;

an inlet duct for transmitting the gas into the space between the platen and the cover;

an outlet duct for receiving gas transmitted from said space; and blower means communicating with the inlet duct and the outlet duct for circulating the gas through said space.

20. Apparatus, as claimed in claim 19, and further comprising cooling means for cooling the gas circulating through the inlet duct.

21. Apparatus, as claimed in claim 20, wherein the gas is air and wherein the predetermined distance is less than ¼ inch.

* * * * *